US006101916A

United States Patent [19]

Panot et al.

[11] Patent Number: 6,101,916

[45] Date of Patent: Aug. 15, 2000

[54] SYSTEM FOR AIDING THE CLEARING OF MINES

[75] Inventors: Christian Panot, Plavignol; René Cochain, Garches; Bernard-Yves Cochain, Elancourt; Raoul Salzberg, Seric, all of France

[73] Assignee: Aerospatiale Societe Nationale Industrielle, France

[21] Appl. No.: 09/009,308

[22] Filed: Jan. 20, 1998

[30] Foreign Application Priority Data

Jan. 22, 1997 [FR] France ..... 97 00629

[51] Int. Cl.[7] ..... G01S 3/02; F41H 11/12

[52] U.S. Cl. ..... 89/1.13; 89/1.11; 102/402

[58] Field of Search ..... 89/1.11, 1.13; 102/402, 403

[56] References Cited

U.S. PATENT DOCUMENTS

| | | | |
|---|---|---|---|
| 2,401,723 | 6/1946 | Deming | 89/1.11 |
| 4,021,725 | 5/1977 | Kirkland | 89/1.13 |
| 4,461,566 | 7/1984 | Pomeroy | 89/1.13 |
| 5,831,198 | 11/1998 | Turley et al. | 89/1.11 |
| 5,886,664 | 3/1999 | Yujiri et al. | 89/1.13 |

FOREIGN PATENT DOCUMENTS

| | | | |
|---|---|---|---|
| 691559 | 1/1996 | European Pat. Off. . | |
| 2 726 677 | 5/1996 | France . | |
| 2548041 | 4/1977 | Germany . | |
| 2726972 | 1/1979 | Germany . | |
| 3824441 | 1/1990 | Germany . | |
| 5201385 | 8/1993 | Japan | 89/1.13 |

OTHER PUBLICATIONS

Vogel et al., Lasers: Devices and Systems–Part III, Electronics, pp. 81–86, Nov. 10, 1966.

*Primary Examiner*—Stephen M. Johnson
*Attorney, Agent, or Firm*—Burns Doane Swecker & Mathis L.L.P.

[57] ABSTRACT

A system for aiding the clearing of mines includes an equipment assembly composed of a portable processing unit (10) having multimedia capabilities, a helmet (12) with projection by overprinting, at least one position sensor (13) integral with the helmet and a camera for taking shots (14), capable of recording the actions of the operator. The system further includes a software assembly composed of software for the management of a data base of the various existing mines, software for the creation of synthesis and animation images, software for retouching an image which allows the images to be improved, and vocal command software.

6 Claims, 3 Drawing Sheets

*MINEX - [Data on the mines]*

File Edit View Insert Record Tools

| 1 | Type of mine | 01 Demonstration mine | Character button |
|---|---|---|---|

| | | | |
|---|---|---|---|
| Main Use | Antipersonnel | Effect | Blast |
| Secondary Use | Training | | with strong |
| Country of manuf. | France | | vertical |
| Countries of use | Sweden, Switzerland, West Germany | | impact |

| | | |
|---|---|---|
| Characteristics | Description | The mine has been used during the civil war in Liberia in 1976. Its effects are not very extensive and it may be used as a mine. |
| Explosive | | |
| Lie of the practice mine | | |
| Detectability | Using technique | The mine must be buried at least 4 cm. The traction device for firing is rather sensitive but must be actuated from bottom to top which generally necessitates a counter motion by a pulley. |

Images

Total information Comparative image Camera image

FIG._4

SYSTEM FOR AIDING THE CLEARING OF MINES

TECHNOLOGICAL FIELD

This invention relates to a system for aiding the clearing of mines.

STATE OF THE PRIOR TECHNOLOGY

At the present time, there are various systems for aiding the clearing of mines for the instruction of operators; but such systems are very rudimentary, they permit management of displayed text but not management of the image. They therefore lack user friendliness. Furthermore they can not be used in operation.

There are a certain number of documents that form part of the general prior technological level.

The document with reference number [1] at the end of the description describes a device for aiding the clearance of mines in which, in order to mark mines in a mine field with a view to clearing them, they are given an "electronic label" which allows them to be identified and to be marked.

The document reference number [2] refers to a viewing helmet called "Dash" from the company Elbit, developed for the firing of an aerial missile. This viewing helmet offers a field of vision of twenty two degrees and a total travel of one hundred and sixty degrees with a resolution of five hundred lines. Elbit has focused its efforts on the ergonomics of its helmet which has been made more compact and lighter, and the optimization of the interface links with the aircraft which allow the user to extend his field of vision with natural movements of the head.

The document reference number [3] describes a device for the detection of an objective, in particular, in order to release the mechanism for setting off a mine by means of a booby trap wire.

The document reference number [4] describes a system and a method for distinguishing targets that can represent mines.

The document reference number [5] describes an inert practice mine, which includes a passive oscillating circuit tuned to a certain frequency, this circuit being intended to be detected by another active oscillating circuit carried by an individual or a vehicle. This document also describes a system for programming such a mine as well as a simulation device for using this mine.

The document reference number [6] describes a training method for searching for mines for teams of mine searchers. This method consists of using a module distinct from the mine, comprising the same detection units which this mine could contain. The module is situated close to or even on the mine. It transmits to the mine hunter data detected by means of its sensors.

The document reference number [7] describes a device for cleaning up a field of pressure sensitive mines that includes notably a moving body which makes use of reservoirs of water, nitrogen and fuel, a storage space of flexible pipe and a running rail.

The document reference number [8] describes a rotating flail system for a vehicle for cleaning up an area strewn with mines.

The document reference number [9] describes a mine that includes a lookout detector with great autonomy which detects the passage of large metallic bodies (vehicles) by measuring the local distortion of the magnetic field.

The document reference number [10] describes a device for detecting munitions that are below the surface of the ground, this device including several sensors and being made up of a group of at least two vehicles.

The purpose of the system of the invention is to provide an operator engaged in mine clearing operations with a system which is the least bulky possible that provides a function of helping in the identification and the handling of mines during mine clearance while, at the same time allowing him free use of his hands and of his natural vision.

DESCRIPTION OF THE INVENTION

This invention relates to a system for aiding the clearing of mines characterised in that it includes:

- an equipment assembly composed of:
  - a portable processing unit, for example a central microcomputer unit with an active matrix screen having multimedia capabilities,
  - a translucent helmet with projection by overprinting
  - at least one position sensor integral to the helmet
  - a camera for taking shots, capable of recording the actions of the operator;
- a software assembly composed of:
  - software for the management of the data base of different existing mines
  - software for the creation of synthesis and animation images,
  - software for retouching an image which allows the images to be improved,
  - vocal command software.

The system of the invention forms a tool for equipping, for facilitating and for giving security to the work of a mine clearer.

It can be used in the context of instruction or, in times of peace, as an aid to the removal of mines from a given area.

The system of the invention guarantees to the operator;

- the preservation of his natural vision
- the free use of both his hands during handling;
- free movement of his body (reduced bulk thanks to the portable solution)

The novel functional principles provided by the system of the invention are the following:

- autonomy through the use of autonomous portable equipment which can be updated since it is modular;
- the possibility of updating by remote transfer of information on a CD-ROM;
- easy and user friendly access to stored data and therefore assistance in the identification of mines;
- use of a thesaurus in order to standardize and consolidate the language employed by different users;
- direct visual comparison of the view of an unidentified object with images recorded in the data base;
- display of a standard sequence (an operational procedure for recommended neutralization) with the operators own actions;
- possibility of recording an account, oral or written, of the operation carried out, possibly accompanied by the recording of a video sequence in real time.

The advantageous multimedia functionalities of the software are the following:

- image processing (zoom, selection of one part of the image, variation of brightness, etc.);
- image comparison (a real image side by side with an image from the data base);

comparison of an operating procedure in direct vision, with the procedure recorded by the camera;

simultaneous vision by the operator of the reference operating procedure on the helmet, and of the real procedure carried out by the same operator (method referred to as enriched reality).

The volume relating to the size of the software and the mine data base, after compression of the data, is about 500 Mb, which is held on one CD-ROM. This characteristic is of great interest, since it allows provision of user autonomy, including when in operation, without having to make use of a satellite link to a central data base.

BRIEF DESCRIPTION OF THE DRAWINGS

FIG. 4 illustrates the welcome screen of the system of the invention.

DETAILED DESCRIPTION OF EMBODIMENTS

The system for aiding the clearing of mines of the invention is intended to facilitate and give security to the work of an operator. It is made up of a portable piece of equipment containing a data base on existing mines that the operator can consult at any time. This system can be used on the one hand for the training of mine clearers, to facilitate their instruction and their training, and on the other hand, in operation, for the preparation of a task and for aiding the recognition of objects to be neutralized and associated booby-traps, and in order to facilitate the task itself.

The training is notably presented in direct vision as operational sequences, from a synthesis or a recording, which guide the student or the operator (the usual method shows the actions in inverted vision facing the teacher or the student) The vocal command and assisted recognition of the objects during processing reassures the operator while leaving him freedom of movement (free hands).

Figure 1:
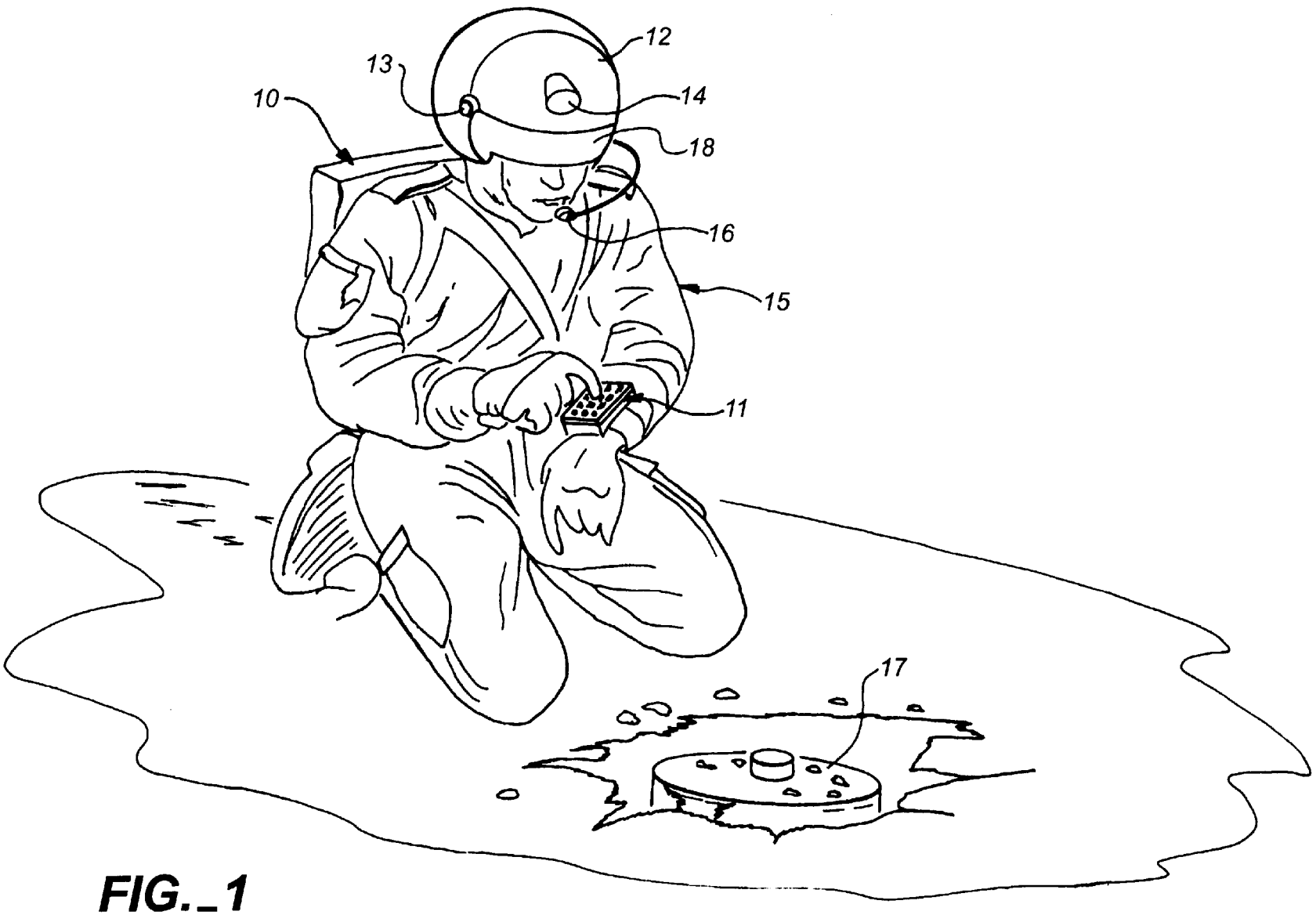
FIG. 1 illustrates the system of the invention.

As illustrated in FIG. 1, the system of the invention includes:

an equipment assembly made up of:

a central portable micro-computer unit 10 (for example a TOSHIBA available on the market) with an active matrix screen having multimedia capabilities; to which are connected:

various standard peripheral devices, and notably:

a command keyboard 11, which can be attached to the wrist of the operator possibly a mouse 19, possibly a CD-ROM drive 23 various specific peripheral devices:

a translucent helmet 12 with projection by overprinting (for example of the HUD type) that allows the creation of partial or total immersion of the operator, at least one position sensor 13 integral with the helmet 12, which allows one either to know the movements of the head or to command different devices a small camera for taking shots 14 (for example of the QUICIKCAM type from Connectics) positioned on the head or the stomach of the operator which records, in direct vision, the actions of the operator 15;

a software assembly made up of:

management software for the data base of different existing mines, for example the mines data base supplied by the UN (700 mines itemized). This can be software of the ACCESS type (DBMS or Data Base Management System from the company Microsoft);

data base management software for a "check-list" of the operations required in order to deactivate the mines;

software for the creation of synthesis or animation images. This can be software of the 3D Studio type (Autodesk company);

software for retouching an image, which allows improvement of the images. This can be software of the PHOTOSHOP type (Adabe company);

possibly software for vocal command of said system;

all other software items that form part of the "tool-box" of the multi-media applications developer.

These items of software are in executable form, that is to say they cannot be modified by the operator.

The equipment assembly can also include:

a vocal command device 16, which can replace the keyboard (for example of the DRAGON DICTATE type);

a GPS radio link, for example an INMARSAT link;

an on-screen editing device: a report made by the operator can be stored in the memory or sent over the radio link. In the context of instruction, this permits verification of what the student has understood.

Figure 2:
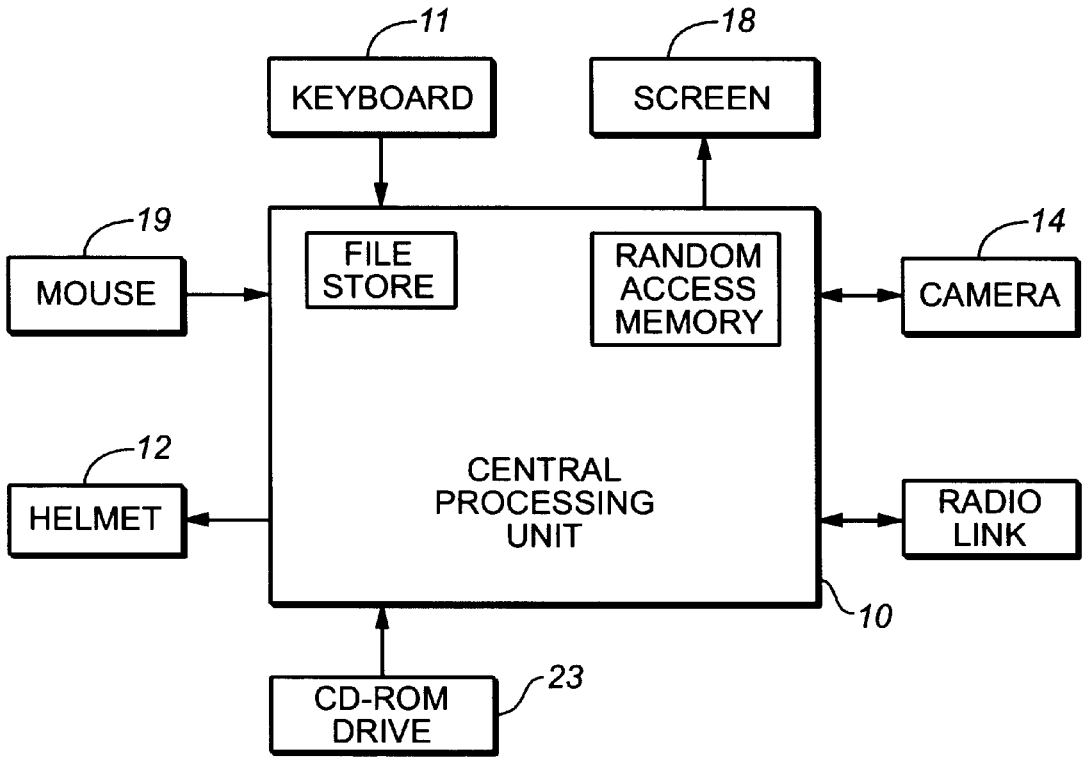
FIG. 2 illustrates diagrammatically the various peripheral devices of the system of the invention.

FIG. 2 illustrates the central processing unit as well as the various peripheral devices that can be connected to it.

The helmet 12 can include:

the display screen 18;

the position sensors 13;

the microphone 16;

possibly earphones (not shown)

The helmet 12 can operate

In virtual reality: the image then takes up the whole field of vision of the operator. Therefore, there is then immersion and interactivity. The sensor or sensors 13, mounted on the helmet, then permit a displacement of the image to occur as a function of the movement of the head: one can have a view of an image from the data base from all the possible points of view. It is possible to command the system vocally with the aid of the microphone 16.

In enriched reality: the image then only takes up part of the field of vision of the operator. Hence the operator can observe, on the one hand his own hands in operation and on the other hand a scrolling manipulation.

Figure 3:
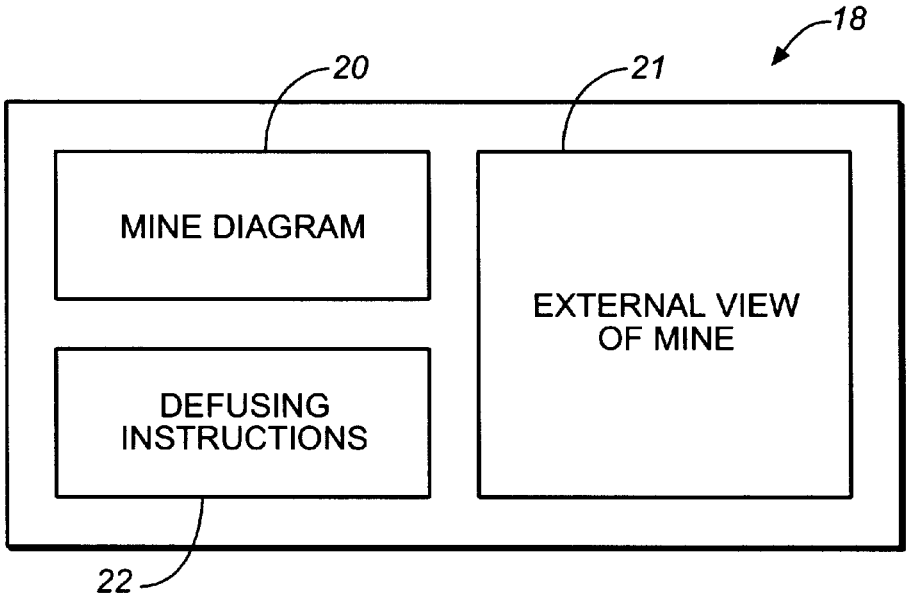
FIG. 3 illustrates an example of a helmet display.

An example of a helmet display is illustrated in FIG. 3 that includes:

a diagram 20 of the mine 17;

an external view 21 of the mine 17;

the instructions for defusing it 22.

It is possible to use the camera for recording. One can then record an action with the camera. One can then scroll this image and carry out a comparison with the image from the data base provided in the helmet.

Advantageously, the various elements of the equipment assembly can be placed in two carrying cases. A first case contains the set of equipment and connections for the device, a second is reserved for the display and immersion helmet.

These two cases only require two external connections one for the mains power supply the other for the connection of the immersion helmet.

One extra connection permits the connection of the assembly to a video projector, or a television set, indeed several, for a wider audience.

An internal battery allows about two hours autonomous operation.

In operation, the operator 15 first detects the presence of a mine 17, brings it to light, and is ready to begin deactivating it.

The set of the following functions is accessible to the operator either by keyboard command or by vocal command.

The first function is help in the identification of the mine: by command using the keyboard or by word, the operator asks the system to project to him on the display on his helmet, photographs or diagrams of the different mines that exist. Identification can be made following several steps:

the operator enters on the keyboard certain characteristic values of the mine (dimensions, shape . . . ) which lead to a preliminary search and a sorting of the data base before display on the visor;

the operator recognises the type of mine on an image.

As soon as the mine is identified, the operator has access to functions to help him defuse it.

to diagrams of the assembly of the mine (plan view, section view . . . ) (graphic information);

to a list of the operations to be carried out in sequence in order to defuse the mine (information of the text and/or sound type).

To the extent it is needed, for each step of the mine clearance, the operator can call up on the display the relevant parts on the diagram of the mine.

The operational procedure for clearing the mine can be supplied either in text form, or in graphic form, or in the form of audio instructions.

At any time, the operator can call up or remove all or part of the displays.

In addition, both the data base of diagrams and the instructions can be changed between tasks so as to take into account new information.

The software organization used by the system of the invention is composed mainly of a data base that allows one to deal with a large number of mines (about 1000, 700 in the current version), described by about fifty characteristics and shown as several images, real or from synthesis, still or animated. Image processing software allows the creation of effects intended to bring the real image acquired by the camera or by direct vision, close to the images from the data base. These images can be recorded for later use.

The data compression methods used allow the volume stored to be limited to a single CD-ROM, which makes the device autonomous. For later updates of the base this avoids satellite or other links and displacements in the course of operation.

Replication of the data base is bi-directional therefore permitting the portable data base to be improved from the main base and vice versa to integrate experience acquired in the field which can be transferred onto the main data base from a recording from the portable terminal.

AN EMBODIMENT EXAMPLE

An example of a real embodiment will now be described below.

The system of the invention includes notably:

a portable micro-computer an interactive data base comprising text files and image files;

a helmet 12 that allows more or less complete immersion of the operator;

a miniature camera 14 that allows the acquisition of images and the display of the operation in progress in direct vision;

complementary items intended for connection and for power supply to the different components.

DATA BASE

The data base is organized from 32 bit software in order to allow non-ambiguous creation of text and image files. Furthermore, the updating and the enquiries to this data base have been made as intuitive as possible and accessible to a person without any particular information technology skills. The integrated information is extracted from the UN data base "Mines Fact".

The executable software supplied allows replication of this base on an office computer, or on portable terminals, meeting the selection criteria for this model.

The images can come from "scanned" documents or photographs either from a digital camera, or from a miniature camera.

The images can be stored after compression. The choice of the degree of compression and the level of quality represents a compromise between the size and the quality of the virtual images put into the memory.

The video sequences can be acquired by a camcorder or with the aid of the miniature camera. As for the images, during the recording it is advisable to choose the best compromise between the size of the stored files and the quality of the recorded images.

USING MODES

In order to describe a mine and its main characteristics, about fifty criteria are necessary. To facilitate the reading of the data base, it has been divided into several screens available from a main menu illustrated in FIG. 4. These screens have their uses at various moments when making use of the data base.

In order to simplify consultation of the data base while avoiding having windows open in a disordered way, most of the screens must be closed in order to access other functionalities (STOP button). In the absence of such organization, the consultation would be confused, the operator running the risk of looking for a window hidden by another.

All the functions of the data base are documented by help bubbles that appear when the mouse is immobilized a few moments on a part of the screen giving rise to a possible action.

There are three types of usage use in the field use at a fixed station use for the training of operators These three types of usage will be considered in succession below.

1/Use in the Field (portable equipment)

The data base can be used in the field. For this use, it would appear to be of interest to bring to the fore the possibilities for search and identification of mines.

It is possible for example to rapidly scroll through all the objects contained in the data base, only displaying the names of mines. It is also possible to move within the data base with the help of buttons of the "video recorder" type. The data can be displayed in two forms:

graphic form sheets of data

The size of the data base created (about 30,000 pieces of information) requires easy and high performance search strategies.

The operator can scroll the whole data base with the buttons in video recorder style or can choose to display the list of all the names of mines by clicking on a button. By clicking on a selected mine the main form giving details of this mine appears.

If the operator does not know the name of the mine: by looking at it, he can specify certain obvious criteria, for example the shape, the country of use or of manufacture.

The system of the invention gives importance to this type of query. It can search for one word in the whole of the data base. For example "yellow" and all the mines containing this criterion will be displayed, in succession (as with simple word processing). It can also limit the display to mines that meet several criteria.

With the filter by form, for example, it is possible to ask for the display of all the mines manufactured in France, of cylindrical shape, of green colour and of the anti-personnel type. After applying the filter, only the mines that meet all the criteria are displayed. This allows one to "navigate" easily through a few mines, which facilitates the determination of the model on which the operation is focused.

It is possible at any time, to search more deeply by adding new selection criteria in order to end up with one single mine that matches all the characteristics.

It is also possible to select one of the criteria of the mine in progress, to run the filter by selection and to obtain all the mines having the same characteristic. From there, the selections can be made in a cascade, until one has no more than a single mine that meets all the successive criteria.

This approach allows one to limit the dangers of identification errors.

2/Use at a Fixed Station

The data base must be regularly updated in order to avoid the sorting and search criteria that have become ineffective. For this the terms used in the data base are grouped together in the form of a limited thesaurus, for example a search based on the criterion "cylinder" does not have an effect for mine entries with the term "cylindrical".

For most of the fields that may be the object of a search by criterion, a list of terms is defined (the thesaurus). This list is not limitative, it is always possible to add complementary information (to a limit of 255 characters, figures or letters). However it is essential that one of the words of the thesaurus be used. This functionality of the data base also avoids errors in spelling that could make a search inoperable, for example "cylunder" is not found if one is searching for "cylinder".

By clicking on the little arrow to the right of a field (main use here) the list of all the criteria in the thesaurus is obtained. When typing, the software automatically displays the first term that agrees with the keys pressed, for example, by typing "su", the word "submarine" is displayed.

The replication function of the data base allows all responses of the data base to be updated without any limitation with regard to their number, for example a fixed work station receives all the important modifications of the data base. The changes carried out are sent back, on request, by any data processing link, network or modem to portable equipment, which allows the update to be throughout the whole world (by using a link on the Internet, by telephone, satellite, etc.).

A remote user in the field can also enter new data in order to improve the data base if he has the authority. At the time of his connection, it is possible to update the main data base from data obtained in the field.

3/Use for the Training of Operators

The facilities for movement in the data base allows mines to be sorted by alphabetical order, by country of manufacture or of use, by use or, more generally by any criterion present in the data base. It is therefore easy to compare mines having close characteristics.

In addition, the images are useful for recognizing a mine. The data base comprises eight fields allowing multi-media documents to be received. These can be of different kinds. They may concern textual data: reports or course aids, with or without images, without any size limitation other than the size of the available memory. They can contain graphics, diagrams, photographs, animations in synthesis images, video films with sound or silent.

These eight fields are divided into two categories: seven for still images, one for animations. Only the first field contains, as a priority, a still characteristic image that facilitates recognition of the mine concerned (this for reasons of presentation of the main form). All the other fields are undifferentiated. However one can always preserve the same field for the same type of record.

METHOD OF USE

The method of using said system of the invention will now be described in this embodiment example.

The description of the mines from the data base created is extrapolated from the UN data base ("Mines Fact"). The data base is installed on a portable computer connected to novel tools: helmet and camera.

Each mine is described by about fifty parameters, certain of which allow fast access through the name, origin, dimensions, materials used, shape, colour, weight, explosive used, method of laying, range, detectability, its image, an animated sequence of standard neutralisation procedure, its history (date and places of use among other things).

This data base can be replicated. It can be modified taking into account certain requests but this causes a resumption of the processing even if the basic principles do not change.

The processing that is set up allows:

- search for a mine described by its name or certain of its characteristics;
- looking up all the characteristics of an identified mine when it is in the data base;
- subsequent modification (creation of new mines, modifications, removal);
- comparison of the main image of a mine from the data base with the direct image recorded with the camera with the possibility of carrying out enlargements of the characteristic parts;
- comparison of the actions made by the operator in direct vision with a standard sequence recorded by an instructor (sequence called a reference sequence);
- replication of all or part of the mines data base both for a descending update of the mobile base (portable computer) and for an update of the main data base from the mobile base, an ascending update;
- printing out characteristic sheets for each mine from the data base.

The use of the helmet and of the camera facilitates instruction, training and practice of mine clearers and task repetition.

The incorporation of image fields (photograph or video sequence) enriches the consultation, facilitates the instruction of the operational procedure for neutralisation, accelerates the acquisition of computerised movements. Due to this it increases the security of the mine clearer when he is in operation.

DESCRIPTION BY FUNCTION

1/Search for a Mine Through a Few Characteristics

As soon as the computer is running, a welcome screen, illustrated in FIG. 4, gives all the characteristics recorded for the first mine in the data base.

This screen includes various data fields called fields.

In order to search and to select a mine defined by certain of these characteristics, one or more selection filters must be applied. It is possible to access the filters held either through icons, accompanied by an information bubble or through menus, or through shortcut keys.

The selection process demands a certain time since it involves the complete looking up of all the characteristics of all the mines. An hour-glass indicates that the selection process is in progress.

The management of the data base is carried out from ACCESS software from MICROSOFT (32 bit software) from which it takes its functionalities.

The management of the windows is that of WINDOWS: close by clicking on the top right of the window, enlargement by clicking on the square of the window, reduction by clicking on the icon.

The "Enter" key permits validation of an operation, the "Esc" key permits its cancellation. The "Tab" key allows one to navigate from one data field or field to the following one, the "F2" function key selects all of a field, the "F3" key searches for the following word in a search/replace operation, the "F4" key scrolls the scroll bar of the field in progress, if there is one, the "F5" key permits the cursor to be positioned directly in the window indicating the number of the mine.

The main functions, represented by icons or data fields are documented by help bubbles when the mouse remains fixed a few moments on an icon.

a) Filter by Selection

When the operator "clicks" on one of the fields of the mine in progress, he selects it.

Another method can be used to select a field, one may simply scroll the list of fields at the top right of the welcome screen and click on the name of the field being looked for. For this it is necessary to know the nomenclature of the fields.

A third method of selecting any field of the mine in progress is to click on the "data sheet mode" icon, which causes the list of mines to appear with all the fields grouped together on a single line (one line per mine). In order to find the field being sought, one simply moves within its column with the help of the "Tab" key. To return to the presentation in "form" mode, one must click on the "form mode" icon.

If the operator then clicks on the "filter by selection" icon, all of the mines in the data base that include an identical value for this field will be selected. The "applied filter" icon lights up and the number of mines held is displayed at the bottom of the screen.

For example, if the data field "main use" is selected with the value "antipersonnel", the act of clicking on the "filter by selection" icon selects all of the "antipersonnel" mines from the data base. The act of then selecting in another field such as "country of manufacture" the value "France" and of clicking on the "filter by selection" icon will select all of the mines from the data base having as a use "antipersonnel" that are manufactured in France (selection in cascade).

It then becomes possible to navigate within that selection with the help of the "video type" buttons: "next", "previous", "first", "last". One can also enter in a window, the order number in the selected list of the mine that one wishes to display. These navigation buttons are situated in two places on the fields of the welcome screen

- at the top, to the right of the bar of icons for managing the data base
- at the bottom to the left of the screen.

It is recommended that the navigation buttons at the bottom of the screen are used which allows more rapid movement within the data base.

It is also possible to enter a mine that one wishes to display, using its order number, in the window at the bottom of the screen.

By clicking again on the icon "filter applied" it darkens; the selection is released; all of the mines in the data base again become accessible. The navigation buttons then allow one to navigate within all of the mines in the data base.

When one wants to remove one of the selection criteria without completely redefining the request, one must carry out the following operations:

- the selection is released by clicking on the "filter applied" icon: this icon goes out;
- one clicks on the "filter/advanced sorting" a screen appears with the list of fields selected;
  - one clicks on the top of the column that one wants to remove (an arrow appears when one is correctly positioned); all of the selected column is black with white characters;
  - one clicks on the "Del" key: the selected column disappears;
  - one clicks on the "filter by selection" icon in order to apply the modified filter: the "filter applied" icon lights up and the number of selected mines appears at the bottom of the screen.

Another way of applying a filter by selection is to operate through a menu:

- a field is selected
- one clicks on the "records" menu;
- the "filter" sub-menu is called up;
- then the "filter by selection" sub-menu.

To apply the selection, one then proceeds in the following way:

- one clicks onto the "records" menu;
- then on the sub-menu "apply the filter: sort".

In order to release the selection, one may also proceed in the following way:

- one clicks on the "records" menu;
- then on the sub-menu "remove the filter: sort".

It is possible to select a filter inside a field with the aid of the mouse (or by selecting a whole word with the aid of simultaneously pressing on the keys shift, control and left or right arrow, a classic procedure under WINDOWS).

For example, one selects the value "Liberia" on the inside of the field "Country of use" and one filters all the mines used in Liberia having possibly also been used elsewhere.

b) Filter by Form

From the welcome screen, one clicks on the "Filter by form" icon. A new screen appears where the fields no longer contain values.

One enters the values corresponding to the mine than one is looking for. As the typing proceeds, the computer completes the word written with the first value contained in the thesaurus included in the data base. This thesaurus can be selected by clicking on the arrow on the scrolling list of the field.

For example, one can enter the value "Antipersonnel" in the field "Main use" and the field "Country of manufacture France", which has the effect of selecting the mines manufactured in France for anti-personnel use (when the values of the different fields selected have been entered, one must click on the icon "Filter applied" in order to operate the selection).

In the same way as for filter by selection, it is then possible to explore the list of selected mines by clicking on the navigation buttons.

If the filter is broad, the selection can be large. In this case, it is better to restrict the selection this being done by adding values into new fields on the form.

Conversely, if the sorting is too restrictive, the selection risks being empty. In this case, it is necessary to broaden the selection by removing one value or another from the selected fields on the form.

Another way of applying a filter by form is to operate through menus:

one clicks on the menu "Records"

one clicks on the sub-menu "Filter"

one clicks on the sub-menu "Filter by form".

By clicking again on the "Filter applied" icon, the selection is released and all of the mines on the data base become accessible again. The navigation buttons are active and once again permit navigation within the whole data base.

c) Advanced Sorting Filter (cascade)

This option corresponds to a request composed of the selection style "antipersonnel" or "antitank" mines, manufactured in "France" or in "Belgium".

For this, on the welcome screen, one clicks on "Filter/advanced sort".

A new screen appears, on which it is possible to enter the values of various fields by clicking afterwards on the option "or" to select the follow-up part of the request.

When the request is complete, one clicks on the "Filter applied" icon to operate the selection.

As previously, it is possible to move within the selection with the help of the navigation buttons.

To cancel this selection, one presses again on the "Filter applied" icon so as to return to the entire data base.

Another way of operating a filter by advanced sorting is to proceed through a menu:

one clicks on the menu "Records"

one clicks on the sub-menu "Filter"

one clicks on the sub-menu "Filter/advanced sort"

The discriminating characters specific to WINDOWS can be used:

"*"=set of any characters

"?"=any one character

For example "*France*" represents a sort of all the fields including the word France including inside the field.

In order to release the selection it is possible to call up the "Records" menu and the sub-menu "Remove the filter/sort".

2/Looking up an Identified Mine a) Looking up using the welcome screen and the following screens Once the mine has been looked for, identified and selected, the welcome screen displays its main characteristics on the following fields:

mine type (its name);

main use;

secondary use;

country of manufacture;

countries of use;

effect;

description;

using techniques,

The first field at the top and to the left of the screen is not listed; it corresponds to the identification number of the mine in the UN data base.

The buttons on the left of the welcome screen allow one to call up the secondary screens:

characteristics;

explosive;

lie of the mine (method of laying the mine);

detectability;

images;

total information.

By clicking on one of the buttons, the corresponding screen is called up. To return to the welcome screen from a secondary screen, one clicks on the "STOP" button.

At the bottom of the welcome screen, the "Comparative image" button allows one to call up the images, still or animated, and the button "Camera image" allows selection of the video image from the camera connected to the equipment (animated or still sequence in the event of stopping on an image). The Comparative image, when it is called up, is a floating window which remains on the screen as long as one does not press on the icon for removal represented by a cross. This allows it to be compared with the images of other mines or those coming from the camera (side by side comparison).

An enlarged image ("Zoom") can be obtained by clicking on the binoculars associated with this image or by clicking on the "Magnifying glass" icon. To quit "Zoom" one clicks on the image itself or on the "Magnifying glass" icon.

A still image of the characteristic appearance of the mine appears at the bottom of the welcome screen. It is possible to enlarge this image by clicking on the pair of binoculars situated to the left of this image.

b) Consulting the Screens Giving the Sequential List of the Characteristics of a Mine By clicking on the welcome screen on the icon situated in the centre of it to the left of the print icon, one accesses the sequential list of all the characteristics of the mine selected. Each mine is defined using about fifty fields.

It is possible to navigate within this list with the help of the scroll bar situated at the right of the screen.

Each line consists of a field wording followed by the value for it for the mine being considered.

By clicking on the "STOP" button, one returns to the welcome screen.

To the right of the value, for certain fields, a small arrow appears directed downwards. By clicking above it, one scrolls a list which corresponds to the preselected values that this field can take. This thesaurus can be added to if new values are known or values that already exist can be modified. However, only an authorised person can add to or modify a thesaurus. This problem is dealt with by the data base administration.

Certain fields are squares to be ticked off: a safety device, delayed arming, self-destruction. The numerical fields are shown with their unit. The image fields are represented in the form of illustrations; they are followed by buttons "comparative image" and "camera direct" that allow the display of enlarged images (still or animated).

3/Modification of the Data Base (administration rights)

It is important to preserve the credibility of the stored information and only to authorize one person or one qualified group of persons to modify the "Mines" data base. At the time of a replication of the data base onto a new portable computer, the administrator determines and grants the rights of the operator relating to the possibility of him modifying the replicated data base. The rights are granted within the "Security" sub-menu of the "Tools" menu.

In order to be validated, a modification must be recorded by the person or the authorised team. To carry out this modification, one selects the "Records" menu and the "Save record" sub-menu.

a) Creation of a New Mine

The creation of a new mine is carried out after having selected the last mine present on the data base, by clicking on the navigation button "Next".

All the fields of this new mine must be provided with information, particularly the integrated images fields, with the help of the camera.

b) Modification of an Existing Mine

For this, one simply selects the mine to be modified and enters the new values in the fields to be modified.

c) Removal of an Existing Mine

The mine that one wishes to delete must be selected by clicking on the "Mine deletion" icon and the deletion must be confirmed.

4/Comparison of a Reference Sequence with the Movement of the Operator

By clicking on the "Images" button to the left of the welcome screen, the "Mine images" screen is selected. Eight illustrations appear on this screen. They are named "Image 1", "Image 2", "Image 3", "Image 4", "Image 5", "Image 6", "Image 7" and "Animation".

The first seven illustrations are accompanied by a pair of binoculars. By clicking on them, one obtains an enlargement of the corresponding image. To return to the screen containing the eight illustrations, one simply clicks on the enlarged image.

By clicking twice on the "Animation" illustration, an animation is started up that shows the standard movements for the neutralisation operation.

By clicking on t he "STOP" button, one returns to the welcome screen.

a) Comparison of the Real Movement while Carrying Out the Action with the Reference Sequence.

The operator, equipped with the display helmet, sees on his screen the animations specified above, of the carrying out of the standard sequence in direct vision form. Compared with the inverse vision form of traditional demonstrations, this presentation is both more realistic and more convenient for the operator. It can compare the standard sequence with the real vision, during execution, which the operator can see through the lower part of the helmet.

He can run, with the mouse, the animation of the reference sequence. After having viewed it as many times as he judges necessary, he must try to reproduce it possibly by freezing images or returning to previous ones.

The reference sequence must not be too rapid since it is a matter of acquiring automatic functioning rather than taking part in a competition.

During an instruction phase or when preparing for a mission, the operator can train himself to reproduce the standard movement to be carried out in total safety.

b) Recording the Users Movement and Comparing with the Reference Sequence

Equipped with the camera 14 pointing towards his hands, the operator starts the taking of shots, by clicking on the "Camera" button. His movements are then recorded by the camera. At the end of the operation, he must click on the "Stop" button.

By clicking on the "Comparative image" button, he can display on the screen, side by side, the standard animated sequence, if this has been stored previously in the comparative image, and what he has just recorded. He can save the recorded sequence for possible examination with his instructor.

5/Transmission Communication from the Data Base a) Replication

A replication of the data base can be carried out by a person authorized to do it by the data base administrator.

To do this, the "Replication" sub-menu must be selected from the "Tools" menu and the instructions on the screen must be followed.

An unauthorized person cannot replicate the data base since the "Replication" sub-menu is not available to him (it appears in grey on the screen).

b) Printing

All or part of the characteristics of a mine can be printed out.

For this, the desired mine is selected and one clicks on the "Print" icon in the centre of the welcome screen, then one follows the instructions on the screen.

One can also call up the "Print" sub-menu from the "File" menu.

An unauthorised person cannot print out the data base, since the "Print" function is not available to him and cannot be selected (icon inactive and the "Print" sub-menu of the "File" menu appears in grey on the screen).

c) A Communication Link with a Word Processor or a Spreadsheet

The characteristics of a mine can be inserted into a text or a table created with the help of software external to the processing of the mines data base. These communications links can only be made if the software in question accept OLE procedure ("Object Linking and Embedding") of Microsoft (for example, WORD and EXCEL)

For this, one must select the desired mine, then click onto one of the three following icons:

- the icon "to WORD" so as to export to the WORD word processor, the selected characteristics of the relevant mine;
- the icon "to EXCEL" so as to export to the EXCEL table the selected characteristics of the relevant mine;
- the icon "Insert OLE objects" so as to import an object coming from an OLE compatible piece of software: image, graphic animation, etc . . . ;
- one may also call up the "OLE/DDE Link" sub-menu from the "Edit" menu, or the "Object" sub-menu from the "Edit" menu (that includes the sub-menus "Read", "Modify", "Open" and "Convert"), or the sub-menu "Special paste" ("Image") from the "Edit" menu;
- an unauthorized person cannot export the data base since the functions "To EXCEL" and "To WORD" cannot be selected (inactive icons and sub-menus appear in grey on the screen).

DESCRIPTION OF THE SCREENS

1/The Welcome Screen

The welcome screen illustrated in FIG. 4 is the mainspring for the processing of the mines data base. After every operation carried out, it is advised that one returns to this screen, by clicking, generally, on the "STOP" button.

This screen includes the text fields, the buttons, the icons, the image fields, and an indicator bar.

At the top of the screen under the bar of icons for managing the mines data base, there are two fields:

- the first on the left, with no title, corresponding to the reference number in the UN data base of the mine in progress;

the second, entitled "Type of mine" corresponding to the name of the mine in progress.

The functions of each of the other components of the welcome screen are described below a) Text Field with Scrolling List These are the following four fields "Main use";

"Secondary use";

"Country of manufacture";

"Countries of use".

By clicking on the arrow directed downwards, to the right of this field, one can scroll the list contained in the thesaurus for this field.

When entering a value for this field, the computer displays the first values from the thesaurus whose first letters are identical to those which have just been typed. This allows the characteristics of the mines to be made uniform within the data base.

If none of the terms in the thesaurus correspond to the value entered, it is possible to decide to add this new value to the thesaurus (if authorisation has been granted by the data base administrator).

The text of these fields is limited to 255 characters.

These fields can be used as elements for a selection made by filtering the data base.

b) Buttons for Calling up Subsequent Screens

Each mine is defined by about fifty fields which are not all on the welcome screen (for reasons of legibility). Certain of them are held therefore on screens called secondary screens, which can be called up using buttons situated on the welcome screen. These buttons, situated to the left of the welcome screen are the following:

"Characteristics";

"Explosive";

"Lie of the mine";

"Detectability";

"Images";

"Total information".

c) Free Text Fields

They are three in number

"Effect";

"Description";

"Using technique".

These fields describe particular features of the mine in the form of free text of unlimited length. A scroll bar to the right of each of the fields allows the text to be explored, when it is not all contained within its window.

d) Image Field

This field is made up of an image at the bottom of the screen. By clicking on the binoculars to the left of this image, one can "Zoom" in on it. Afterwards, one simply clicks on the enlarged image in order to return to the welcome screen.

This image which is the most characteristic of the mine concerned, is the first of eight images; it is named "Image 1" on the mines screen.

e) "Comparative Image" and "Camera Image" Fields

These two fields are situated at the bottom and to the right of the welcome screen.

By clicking on the "Comparative image" field, a floating window is created that contains the image from the welcome screen. It can be moved by clicking on its title bar and then dragging it with the mouse to the desired place.

The comparative image remains active as long as its closure has not been selected by clicking on the cross situated at the top and to the right of this window.

This makes it possible, by displaying the images of other mines or those recorded by the camera, to compare them side by side with the comparative image.

The field "Camera image" allows an animated image entered by the camera to be selected. It is necessary to correctly direct the camera before starting this operation. The operator can stop the recording of the camera at any time by clicking on the "Stop" button. He can then run through the camera recording with the help of the navigation cursor and is also able to freeze an image and to "slide and place" the frozen image to one of the seven illustrations "Image 1" to "Image 7".

This possibility is an original contribution of this system. It should contribute to instruction and to preparation for a mission.

f) Icons for Managing the Mines Data Base

These icons are situated on the bar below the menu bar, or in the centre of the screen for the two icons "List of mine names mode" and "Print", and finally at the bottom to the right of the screen for the "Quit" icon.

f1) Form Mode, Data Sheet Mode or List of Mine Names Mode

The two icons the furthest to the left of the icon bar, situated under the menu bar represent the following two modes:

form mode (default mode) representing the welcome screen;

data sheet mode representing the list of mines with all their fields in columns (about fifty), at the rate of only one line per mine.

One can pass from form mode to data sheet mode by clicking on the "data sheet mode" icon.

Vice versa, one passes from data sheet mode to form mode by clicking on the "Form mode" icon.

The icon that allows presentation of the data base as a list of mine names is situated in the middle of the navigation buttons at the top of the screen. In this mode, the mines are listed sequentially, at the rate of one mine per line, each being identified by its UN number and by its name.

The list of mines represents, possibly, the result of an ascending or descending sort carried out on one of the fields.

f2) Communication Link with the WORD Word Processor or the EXCEL Spreadsheet

The two icons "To WORD" and "To EXCEL" are situated to the right of the "Data sheet mode" icon. They allow mine characteristics to be exported from the data base to a text under WORD or a spreadsheet under EXCEL.

The link thereby created allows a text or a table to be updated in a transparent way, as soon as the data base itself is modified.

f3) Spelling Corrector

The following icon in the icon bar is named "Spelling corrector".

As its name indicates, pressing this icon puts automatic spelling correction into action. As the text is typed, an identified typing or spelling error triggers an error signal underlining in red the dubious word. The operator is able to not take account of this and can even have the new word entered in the corrector's dictionary.

f4) Insertion of an Object (image, animation, . . . )

This function allows the addition of external images, for example those recorded by the camera possibly after retouching or synthesis images.

f5) Searching for a Word in the Data Base

The three following icons allow the search and replacement functions to be put into operation:

search for a word in the data base search for the following word;

search for and replace a word

Pressing the icon "search for the following word" allows a search screen to be displayed. The search can be limited to a single field or extended to the whole data base.

Pressing the icon "Search for the following word" allows one to localise the following word corresponding to the request.

f6) Sort (ascending or descending)

By clicking on one of these two icons, the data base is sorted in an ascending or descending way, depending on the icon, from the field selected, which can be situated on the welcome screen or on one of the secondary screens.

One can, for example, sort the data base into alphabetical order of the countries of manufacture. This allows one very rapidly to find a mine whose country of manufacture is known.

The other method is to run a search for a given word that identifies the mine being looked for.

f7) Filters (form, selection, advanced sort)

The four following icons relate to the selection of a part of the data base with the help of a filter:

"Filter by selection";

"Filter by form";

"Filter/advanced sort";

"Filter applied".

These filters allow one to carry out the following filter operations:

to select the mines including a given value in one of the fields;

to select the mines having given values in several fields;

to select the mines having one from among given values in one of the fields;

to select the mines having one among several given values in several fields.

The selection can be carried out in a single action, or on the other hand in a progressive manner by refining the request as one goes along. This is the principle of cascade filtering. The filter by selection operates as follows:

one selects a field of a mine and one clicks on the "Filter by selection" icon; the "Filter applied" icon lights up and, after a certain time required to process the request, the selection is made; it is possible to navigate within this selection with the help of the navigation buttons; the act of clicking on the "Filter by selection" icon after having selected a new field will operate a second filtering operation on the already filtered list.

in the filter by form option, the selection is made in a different order: one clicks on the "Filter by form" icon to cause the welcome screen to appear with empty fields; the operator can then enter values in certain of these fields and then click on the "Filter applied" icon, which, after a more or less long processing time, will cause to appear a selected list of mines corresponding to the filter requested;

the filter/advanced sort option consists of clicking on the "Filter/advanced sort" icon. Then on the new screen that appears, one selects the fields and the filter values and then one clicks on the "Filter applied" icon.

Before any filter operation other than a cascade filter, one must pay attention to releasing any selection that is in progress, if there is one, by clicking on the "Filter applied" icon which then goes out.

f8) Sequential Exploration of the Data Base (two areas)

It is possible to navigate within the mines data base, over all or part of it, after having carried out a sort or without any sorting.

The navigation buttons are situated in two places on the welcome screen (to the right of the icon bar, or at the bottom and to the left of the screen). The navigation buttons in the icon bar, from left to right, are the following:

first mine in the list;

previous mine in the list;

icon allowing access to the list of names of selected mines;

next mine in the list;

last mine in the list;

new mine (for a creation);

removal of the mine in progress.

The options of creating and removing mines are normally darkened and hence cannot be used, if the operator does not have the authority to do this.

To the right of these buttons there is a window with a scrolling list, within which the name of the field currently selected is displayed.

The navigation buttons at the bottom and to the left of the welcome screen are, from left to right, the following:

first mine in the list;

previous mine in the list;

a window indicating the number of the mine in progress in the list;

next mine in the list;

last mine in the list;

new mine (for a creation).

The new mine icon is darkened, and hence cannot be used, if the operator has not had the authority to do this.

To the right of these buttons, the number of mines in the selection is indicated.

f9) Sequential Display of all the Characteristics of one Mine from the Data Base By clicking in the centre of the navigation buttons of the icon bar, one accesses the list of names of mines at the rate of one mine per line, including its name and its number.

The icon in the centre of the welcome screen, to the left of the print icon, also allows access to the list of mines, but in form mode with the list of all the fields (about 50), accessible with the help of a scroll bar situated on the right of the screen.

f10) Printing

The print icon in the centre of the welcome screen allows one to obtain, after a preview before printing, and to publish all the characteristics of a mine on a single page.

f11) Quit

By clicking on the icon that represents a half-open door at the bottom and to the right of the screen, one quits the application.

g) Indicator Bar

A status indicator bar, at the bottom of the welcome screen, indicates the position or the status of certain keys:

"FILT", a filter is applied;

"MAJ", the letters are in upper case

"NUM", the numeric keypad is in number mode (if not, it is in cursor displacement mode);

"FRAP", the typing is in overwrite mode (if not, it is in insert mode).

There can be other screens:

2/List of Mines Screen

This screen is called up by clicking on the icon in the centre of the navigation buttons at the top of the welcome screen.

The icon bar on the welcome screen can be found again on this secondary screen, as for the other secondary screens below, except for the "Mines images" screen.

The list of selected mines appears on it (one line per mine). On each line the heading "Mine type" is displayed followed by the name of the mine. One can also click on the function key "F5" so as to find oneself again in the mine numbers window, then enter the number of the desired mine and then validate this selection by clicking on the "Enter" key.

By clicking on the name of the mine that one wishes to display, one causes the welcome screen for this mine to appear, the selection is then reduced to this single mine (the number of selected mines displayed at the bottom of the screen is equal to 1).

3/Mine Characteristics Screen

This secondary screen is called up by clicking on the "Characteristics" button on the welcome screen.

Above the title bar of this screen, headed "Mine characteristics" the UN number of the mine (without a heading) and the name of the mine are to be found.

This screen includes the following fields:

"Main material", with a thesaurus on a scrolling list;

"Secondary material", with a thesaurus on a scrolling list;

"Shape", with a thesaurus on a scrolling list;

"Colour";

"Length of the mine", in mm;

"Width of the mine", in mm;

"Height of the mine", in mm;

"Diameter of the mine", in mm

"Total weight", in kg;

By clicking on the "STOP" button at the bottom of this secondary screen, one returns to the welcome screen for the selected mine.

4/Explosives Characteristics Screen

This secondary screen is called up by clicking on the button "Explosives" on the welcome screen.

Above the title bar of this screen, headed "Explosives characteristics", one finds the UN number of the mine (without a heading) and the name of the mine.

This screen comprises the following fields:

"Explosive type";

"Booster charge";

"Weight of the booster", in kg;

"Detonator model";

"Type of detonator";

"Triggering pressure";

"Detonator No.";

"Total weight", in kg;

"Weight of explosive", in kg;

"Non-explosive weight", in kg.

By clicking on the "STOP" button at the bottom of this secondary screen, one returns to the welcome screen for the selected mine.

5/Lie and Range of the Mine Screen

This secondary screen is called up by clicking on the "Lie of the mine" button on the welcome screen.

Above the title bar of this screen, headed "Lie and range of the mine", one finds the UN number of the mine (without a heading) and the name of the mine.

This screen comprises the following fields:

"Method of laying", a free text field with scroll bar;

"Depth of burial" with two values in mm;

"Min."

"Max.";

"Area of effectiveness", with two values in m;

"Min.";

"Max.";

"Energy";

"Explosion height", in m;

"Max. penetration", in cm;

"Arming time delay", with a square to be ticked and two values in s:

"Min."

"Max.";

"Safety device", square to be ticked;

"Submarine use", square to be ticked;

"Triggering pressure".

By clicking on the "STOP" button at the bottom of this secondary screen, one returns to the welcome screen for the selected mine.

6/Detectability of the Mine Screen

This secondary screen is called up by clicking on the "Detectability" button on the welcome screen.

Above the title bar of this screen, headed "Detectability of the mine", one finds the UN number of the mine (without a heading) and the name of the mine.

This screen comprises the following fields

"Detectability";

"Anti-interference devices", square to be ticked;

"Presence and quantity of metal", square to be ticked and text field;

"Selfdestruction", square to be ticked and text field.

By clicking on the "STOP" button at the bottom of this secondary screen, one returns to the welcome screen for the selected mine.

7/Images of the Mines Screen

This secondary screen is called up by clicking on the "Images" button on the welcome screen.

Above the title bar of this screen, headed "Images of the mines", one finds the UN number of the mine (without a heading) and the name of the mine, then the recall for two fields from the welcome screen: "Main use" and "Secondary Use".

This screen comprises the eight illustrations "Image 1", "Image 2", "Image 3", "Image 4", "Image 5", "Image 6", "Image 7" and "Animation".

Each of the seven illustrations "Image 1" to "Image 7" is accompanied by a pair of binoculars onto which one can click so as to "Zoom" onto the corresponding illustration, enlarging it over the whole screen. By clicking onto the enlarged image, one returns to the "Images of the mines" screen.

To run the animation, one must click twice on the "Animation" illustration.

In order to create a comparative image, one of the illustration must be selected by clicking on it and then clicking on the "Comparative image" button.

To select the image recorded by the camera, one must click on the "Camera" button. A new screen appears.

On the camera screen, if one clicks on the "Record" icon, one starts the recording of the sequence in the camera field which is broken off by clicking on the "Stop" button.

One can then view this sequence by clicking on the "Read" icon; one can also drag the read cursor with the mouse and stop by positioning the cursor in the place that one wishes, in order to select one of the images from the recorded camera sequence that one can then "slide and place" on one of the illustrations 2 to 7 ("Image 1" is left untouched, it is reproduced on the welcome screen). One can also "slide and place" the whole of the recorded camera sequence on the "Animation" illustration.

It is possible to "Zoom" into a part of the image in an illustration by clicking on the "Magnifying glass" icon and then dragging the area of the illustration that one wishes to process with the mouse.

By clicking on the "STOP" button at the bottom of this secondary screen, one returns to the welcome screen for the selected mine.

8/Screen Giving the Sequential List of all the Fields for a Mine

This secondary screen with a title bar headed "Data on the mines" is called up by clicking on the "Total information" button on the welcome screen.

The fifty or so fields for a mine are displayed sequentially at the rate of one field per line.

Since all of the fields for a mine cannot be contained on a single screen, a scroll bar to the right of this screen allows one to scroll through the fields.

At the bottom of the screen, the navigation buttons allow one to explore the selected mines.

One can also press the function key "F5" so as to return to the mine number window, enter the number of the desired mine and then validate this selection by pressing the "Enter" key.

9/Preview Before Printing Screen

This secondary screen with a title bar headed "Data on the mines" is called up by clicking on the "Print" button in the middle of the welcome screen. It gives a preview before printing.

The fifty or so fields for a mine are displayed on one page, the illustrations being arranged on the right of this page.

By clicking on the "Page layout" icon to the left of the icon bar, the printing characteristics are set up, such as, for example, the choice of portrait mode or landscape mode.

By clicking on the "Print" icon on this screen, one starts printing the page.

By clicking on the "Close" button on this secondary screen, one returns to the welcome screen for the selected mine.

10/Comparative Image Screen

This secondary screen with a title bar headed "Comparative image" is called up by clicking on the "Comparative image" button on the welcome screen.

Below the title bar of this screen one finds the UN number of the mine (without a heading) and the name of the mine, then the recall for two fields from the welcome screen: "Main use" and "Secondary Use".

At the bottom of the screen, the navigation buttons allow one to explore the images of the selected mines.

REFERENCES

[1] EP-A-0 716 286

[2] An article entitled "The Israelis target the French market" that appeared in the magazine "Air et Cosmos" (NO. 1588, Nov. 22, 1996)

[3] FR-A-2 708 099

[4] FR-A-2 717 269

[5] FR-A-2 730 557

[6] FR-A-2 711 606

[7] FR-A-0 360 234

[8] FR-A-0 365 264

[9] FR-A-2 731 805

[10] FR-A-2 699 288

What is claimed is:

1. A system for aiding the clearing of mines by an operator comprising:

an equipment assembly comprising:

a portable processing device (10) having multimedia capabilities;

a helmet (12) having a display (18) onto which information is projected by overprinting;

at least one position sensor (13) integral with the helmet;

a camera for taking shots (14), capable of recording actions of the operator; and a software assembly comprising:

software for the management of data bases of different existing mines;

software for the creation of synthesis and animation images relating to mines;

software for retouching an image relating to a mine which allows the images relating to mines to be improved; and vocal command software for commanding the management, creation, and/or retouching software.

2. A system according to claim 1, wherein the processing device (10) is a computer with an active matrix screen for displaying information relating to mines.

3. A system according to claim 1, further comprising a command keyboard.

4. A system according to claim 1, further comprising a vocal command device for interacting with the vocal command software.

5. A system according to claim 1, further comprising a GPS radio link.

6. A system according to claim 1, further comprising an on-screen editing device for editing information relating to mines.

* * * * *